United States Patent [19]

Neal

[11] 4,139,330

[45] Feb. 13, 1979

[54] ADJUSTABLE VANE CENTRIFUGAL PUMP IMPELLER CONSTRUCTION

[75] Inventor: Maynard J. Neal, North Tonawanda, N.Y.

[73] Assignee: Buffalo Forge Company, Buffalo, N.Y.

[21] Appl. No.: 787,472

[22] Filed: Apr. 14, 1977

[51] Int. Cl.[2] ..... F04D 29/24

[52] U.S. Cl. ..... 416/87; 416/143; 416/186 A; 416/207; 416/208

[58] Field of Search ..... 416/186, 186 A, 207, 416/208, 143, 87; 415/DIG. 3

[56] References Cited

U.S. PATENT DOCUMENTS

| | | | |
|---|---|---|---|
| 1,427,391 | 8/1922 | Johns | 416/207 X |
| 2,950,686 | 8/1960 | Ledel et al. | 416/186 A X |
| 3,131,956 | 5/1964 | Bailey | 415/DIG. 3 |

FOREIGN PATENT DOCUMENTS

| | | | |
|---|---|---|---|
| 337179 | 6/1921 | Fed. Rep. of Germany | 416/186 A |
| 1052818 | 3/1959 | Fed. Rep. of Germany | 416/186 A |
| 2302351 | 7/1973 | Fed. Rep. of Germany | 416/186 A |
| 892284 | 4/1944 | France | 416/186 A |
| 1148127 | 12/1957 | France | 416/186 A |
| 1307113 | 9/1962 | France | 416/186 A |
| 185139 | 8/1922 | United Kingdom | 416/186 A |
| 324714 | 2/1930 | United Kingdom | 416/186 A |
| 737785 | 10/1955 | United Kingdom | 416/186 A |

*Primary Examiner*—Everette A. Powell, Jr.
*Attorney, Agent, or Firm*—Joseph P. Gastel

[57] ABSTRACT

An adjustable centrifugal impeller including a hub, a plurality of elongated vanes located circumferentially on the hub with each of the vanes having inner and outer portions, an annular ring mounted for circumferential sliding movement on the hub, first fasteners extending directly between the inner portions of the vanes and the annular ring for fastening the inner portions of the vanes directly to the hub, and second fasteners extending directly between each of the outer portions of the vanes and the hub for fastening the outer portions directly to the hub, and a plurality of locations on the vanes for receiving the second fasteners to thereby adjust the positions of the vanes on the hub, each of the vanes having a flat face which bears against flat faces of the annular ring and the hub to provide a rigid connection therewith through full face-to-face contact of the overlapping parts.

11 Claims, 12 Drawing Figures

22
19
18
17
31
20
30
23
33
29
32
26
24
27
25
21
10
12
16
21
14
15
14'
11
34'
13
34
18
22

10
2
17
19
20
23
22
31
30
32
25
21
12
34
11
34'
14
15
14'
13
2

34
24
29
32
31
19
17
25
21
15
22
23
20
14
12
14'
27
33
13
11
34'
10

34
25
29
30
32
19
17
21
15
22
20
23
14
12
14'
27
11
33
13
34'
10

ADJUSTABLE VANE CENTRIFUGAL PUMP IMPELLER CONSTRUCTION

BACKGROUND OF THE INVENTION

The present invention relates to an improved adjustable vane centrifugal pump impeller.

By way of background, in certain applications it is desirable to have an adjustable vane impeller for use with a centrifugal pump. In this manner, the characteristics of the impeller may be changed to meet varying field requirements so that maximum pump efficiency can be obtained. In the past, the adjustability of impellers for centrifugal pumps has been effected by the use of relatively complex linkages or expensive constructions. For example, in U.S. Pat. No. 2,950,686, the adjustability of air foil sections was effected by means of an annular ring coupled to the blades through an intermediate linkage, which rendered the structure relatively complex, as was the case with the subject matter of U.S. Pat. No. 2,687,280. In U.S. Pat. Nos. 2,361,007 and 2,671,635 a central ring gear was utilized to rotate a plurality of pinions simultaneously, with each of the pinions mounting a blade, and each of these constructions was also relatively complex and expensive. In U.S. Pat. No. 2,719,000 an adjustable bladed impeller is disclosed wherein the blades adjust their position in use against the bias of a spring member, as is the case in U.S. Pat. No. 1,445,402. In addition, in all of the prior patents there was limited contact between the various parts, as through pins or gear and pinion connections, rather than the full face-to-face contact of the present invention, as described in detail hereafter. Thus, none of the prior patents disclose a relatively simple attachment construction for mounting the vanes of a centrifugal impeller on a hub in an extremely simple, expedient and dependable manner.

SUMMARY OF THE INVENTION

In accordance with one aspect of the present invention, an adjustable centrifugal impeller is provided having a hub, a plurality of elongated vanes located circumferentially on said hub with each of said vanes having inner and outer portions, first fastening means extending directly between the inner portions of the vanes and the hub for fastening the inner portions directly to the hub, and second fastening means extending directly between each of the outer portions and the hub for fastening the outer portions directly to the hub in a plurality of different angular positions of the vanes. By fastening all portions of the vanes directly to the hub instead of through intermediate linkages, the structure is greatly simplified. In accordance with another aspect of the present invention, there is full face-to-face contact between the bases of the vanes and the adjacent portions of the hub, to thereby enhance the rigidity of the structure in every adjusted position. The various aspects of the present invention will be more fully understood when the following portions of the specification are read in conjunction with the accompanying drawings wherein:

DESCRIPTION OF THE PREFERRED EMBODIMENTS

Figure 2:
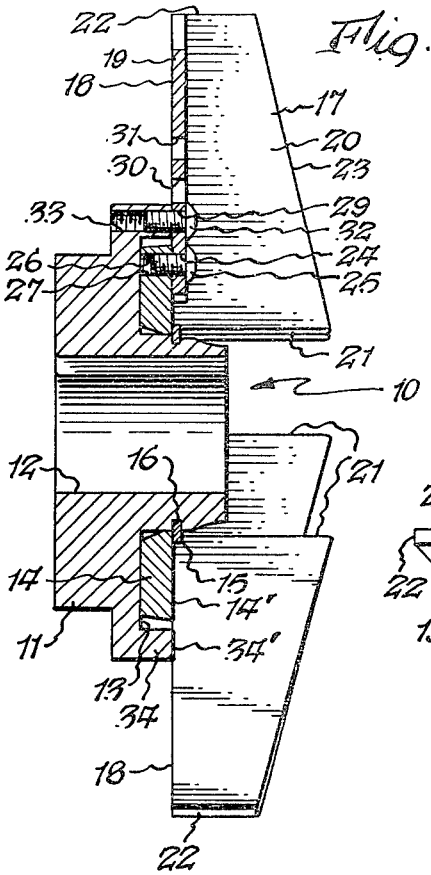
FIG. 2 is a cross sectional view taken substantially along line 2—2 of FIG. 1.

The improved impeller construction 10 of FIGS. 1–5 includes a hub portion 11 having a central bore 12 for receiving a shaft (not shown). An annular groove 13 is formed on one side of hub 11 for receiving an inner hub portion or annular ring 14 which is retained in position by a snap ring 15 which is in turn received in annular groove 16. Annular ring 14 is circumferentially slidable in groove 13.

A plurality of elongated vanes 17 are adjustably mounted on hub 11. In this respect, each vane 17 includes a base portion 19 and a vane portion 20 which extends perpendicularly thereto. As can best be seen from FIG. 2, each vane portion 20 has its greatest height at inner edge 21 and its lowest height at outer edge 22, with a straight edge 23 joining the inner and outer edges opposite to base 19. As can best be seen from FIG. 2, each vane portion 20 is in the shape of a trapezoid, but it can have any other shape, such as a rectangle, or edge 23 can be curved.

Figure 1:
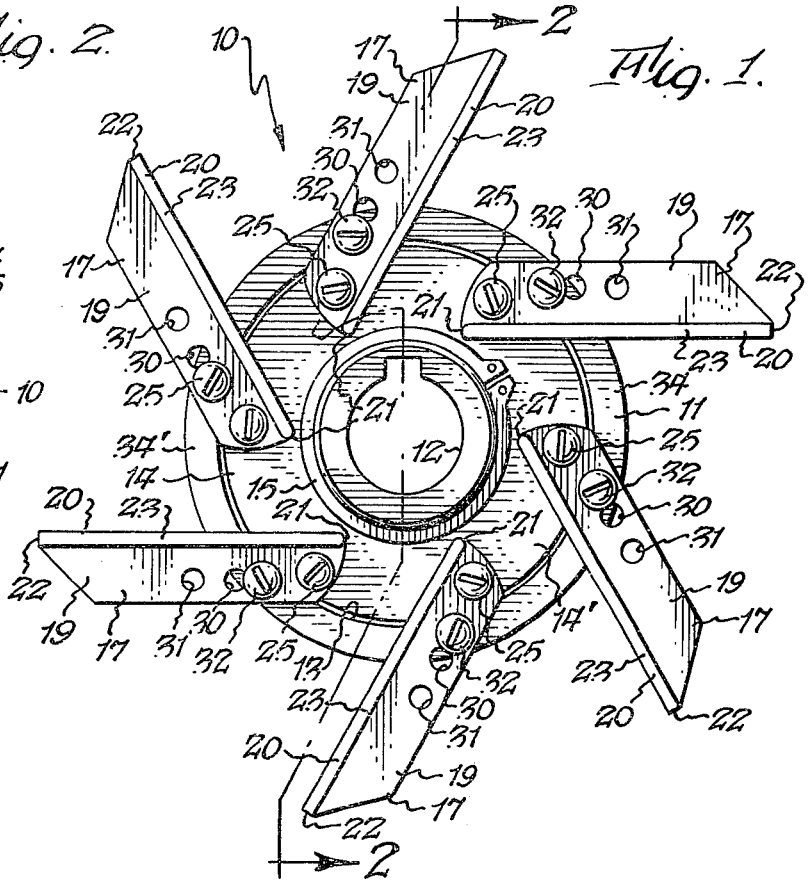
FIG. 1 is a plan view of one form of the improved impeller with the vanes in a first adjusted position.
Figure 3:
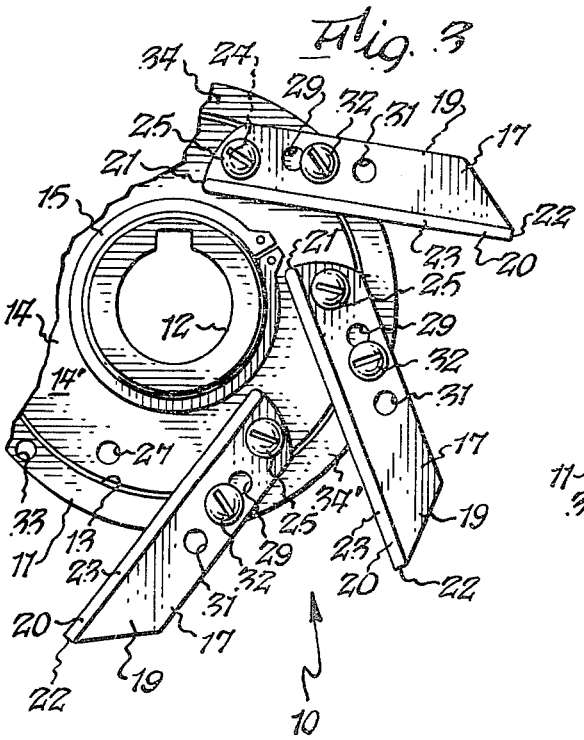
FIG. 3 is a fragmentary plan view of the impeller of FIG. 1 but showing the vanes in a second adjusted position.
Figure 4:
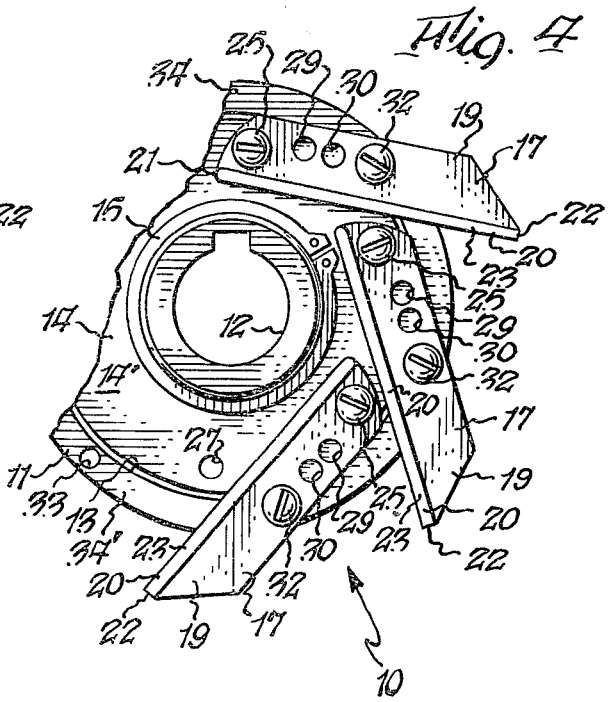
FIG. 4 is a fragmentary plan view of the impeller of FIG. 1 but showing the vanes in a third adjusted position.

Each vane 17 can be directly mounted on the hub 11 in a plurality of different positions, as can be seen from a comparison of FIGS. 1, 3 and 4. In these different positions, the inlet angles, discharge angles, vane overlaps, and opening between vanes is different. Thus, by adjusting the vanes 17 on hub 11 different characteristics may be obtained. More specifically, each base portion 19 includes an aperture 24 (FIGS. 2 and 3) at the inner portion thereof for receiving a screw 25 with a clearance, the stem 26 of each screw being threadably received in a tapped bore 27 in annular ring 14. Alternatively, a rivet which permits the blade to swivel or pivot, may be used. Each base 19 also includes a plurality of radially spaced apertures 29, 30 and 31 in the outer portion thereof. A screw 32 is of a size to selectively extend through apertures 29, 30 and 31 with a clearance and is received in a threaded bore 33 in outer portion 34 of hub 11. It can thus be seen that the use of fasteners 25 and 32 permits direct fastening of spaced portions of the vanes to the inner and outer hub portions. There is no intermediate linkage used. The direct connection is simple, inexpensive and dependable.

The above described construction permits simple adjustment of the vanes 17 between the positions shown in FIGS. 1, 3 and 4, and once the impeller has been adjusted, it is extremely rigid because of the direct connections between the vanes and the hub and because of the full face-to-face engagement between the vanes and the hub portions, as will appear hereafter. In this respect, all that is necessary to adjust from the position of FIG. 1 to the position of FIG. 3 is to loosen each of screws 25, remove each of screws 32 from threaded bores 33 and apertures 29, slide ring or inner annular hub portion 14 circumferentially until each of apertures 30 are in alignment with bores 33, reinsert screws 32 through apertures 30 and bores 33, and thereafter tighten screws 25. In adjusting the vanes from the position of FIG. 3 to the position of FIG. 4, a similar action is performed except that screws 32 are inserted through apertures 31 and are received in bores 33. It is to be noted that whenever screws 32 are inserted through corresponding apertures, such as 29, 30 or 31 in each of the vanes 17, the latter will automatically align themselves at the proper angle and further it is to be noted that inner annular ring 14 will automatically slide circumferentially to the proper position. Once each pair of screws 25 and 32 associated with each vane 17 is tightened, the resulting impeller assembly will be extremely rigid, and such rigidity is enhanced by the fact that the flat undersurface 18 of each base 19 bears against the flat faces 34' and 14' of outer hub portion 34 and annular ring 14, respectively. It will be appreciated that while the flat contacting surfaces are preferred, the direct connections between the vanes and the hub can be realized without such flat contacting surfaces throughout the overlap between the vanes and the hub. It is also to be noted that the vanes are extremely simple in construction in that they are essentially of angle-shaped cross section.

Figure 5:
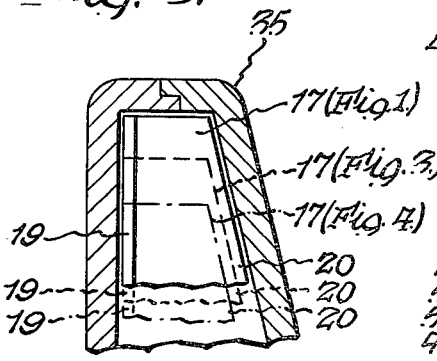
FIG. 5 is a fragmentary cross sectional view through the impeller housing and showing the relationship between such housing and the vanes in the positions of FIGS. 1, 3 and 4.

In FIG. 5 the relative positions of the vanes 17 are shown in the impeller housing 35. In this respect, it can be seen that when the vanes 17 are in the position of FIG. 1 (solid lines), they have a relatively close clearance with the inner walls of housing 35; when they are in the position of FIG. 3 (dotted lines), they have an intermediate clearance; and when they are in the position of FIG. 4 (dashdot lines), they have a relatively large clearance. The advantage of the foregoing is that as the vanes wear, as they do when they are used for pumping abrasive materials, they can be adjusted, for example, from the position of FIG. 4 to the position of FIG. 3 to compensate for wear. Furthermore, as will be appreciated, by mounting the vanes 17 in their various adjusted positions, different pumping characteristics may be obtained.

Figure 6:
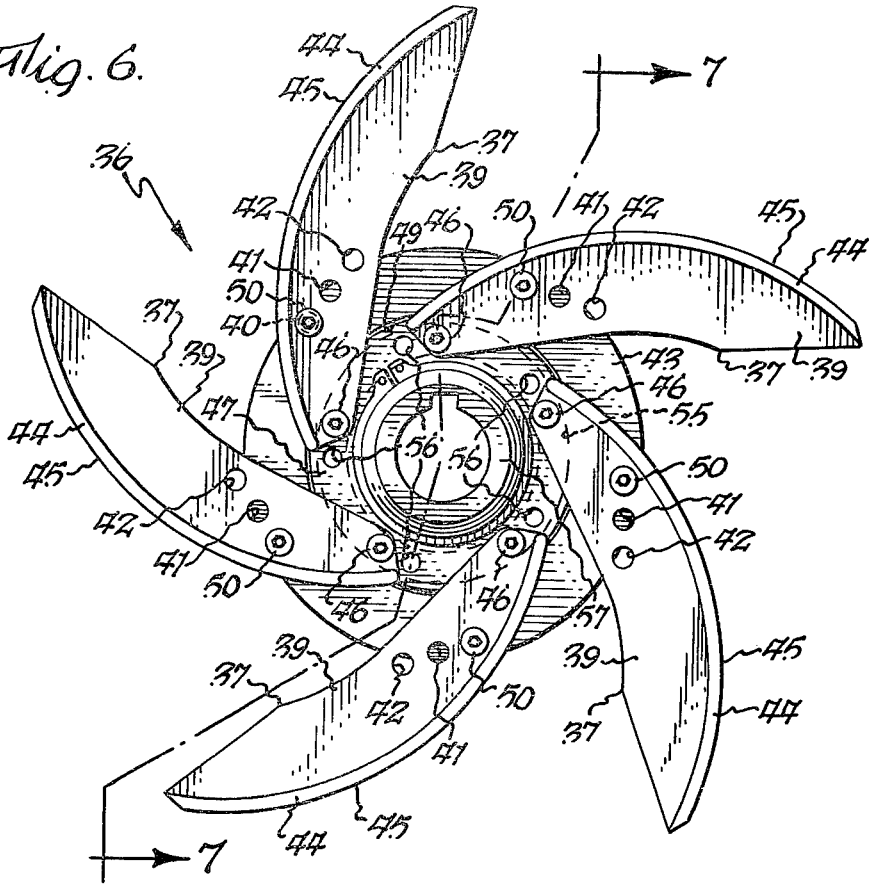
FIG. 6 is a plan view of a second form of impeller having vanes of a configuration which differs from those shown in FIG. 1 and also having a different hub construction.
Figure 7:
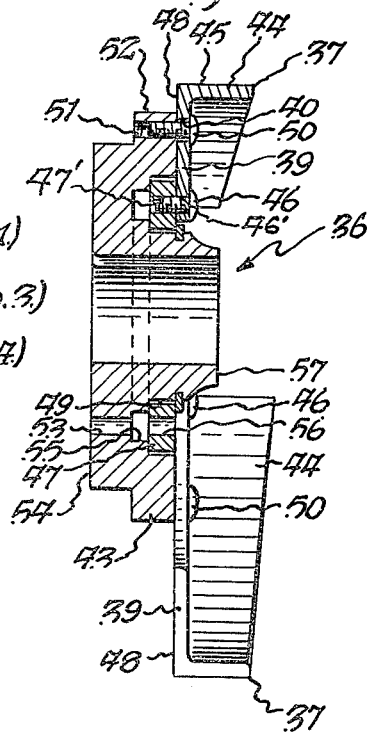
FIG. 7 is a cross sectional view taken substantially along line 7—7 of FIG. 6.

In FIGS. 6 and 7 a modified impeller construction 36 is shown. This construction differs from the embodiment of FIGS. 1–5 in certain respects. First of all, as can be readily observed, the configuration of vanes 37 is different. In this respect, the base portions 39 are larger so that the adjusting apertures 40, 41 and 42 can extend more tangentially to hub 43 than do apertures 29, 30 and 31 relative to hub 11. Furthermore, the upstanding portions 44 of the vanes have a curved leading edge 45. In addition, there is a communication pathway between the rear and the front of the impeller for pressure equalization.

As with the embodiment of FIG. 1, inner screws 46 extend, with a clearance, through apertures 46' in the base portion 39 of the vanes and are received in tapped bores 47' in an inner annular adjusting ring 47 which is circumferentially slidable in annular groove 49. The outer portions of vanes 37 receive screws 50 which extend with a clearance through preselected apertures 40, 41 or 42 and are received in tapped bores 51 in outer hub portion 52. The hub 43 also includes a plurality of bores 53 which extend between the rear face 54 of hub 43 and an annular groove 55 (FIG. 7) which is in communication with bores 56 in annular ring 47. By virtue of the foregoing arrangement there can be pressure equalization between the rear face of the hub 54 and the front face 57. In other words, there are five bores 53 in the hub 43, and such bores are spaced at 72° from each other. In addition, there are five bores 56 in annular ring 47, and such bores are also spaced equidistantly at 72° from each other. It will readily be appreciated that regardless of the relative positions of annular ring 47 and the remainder of the hub, there will always be communication between the rear face 54 of the hub and the front face 57 through bores 53, annular groove 55, and bores 56. It is to be noted that the flat faces 48 of the rear of bases 39 pressing against the flat faces of the ring 47 and outer hub portion 52 enhances the rigidity of the impeller when screws 46 and 50 are tightened.

Figure 8:
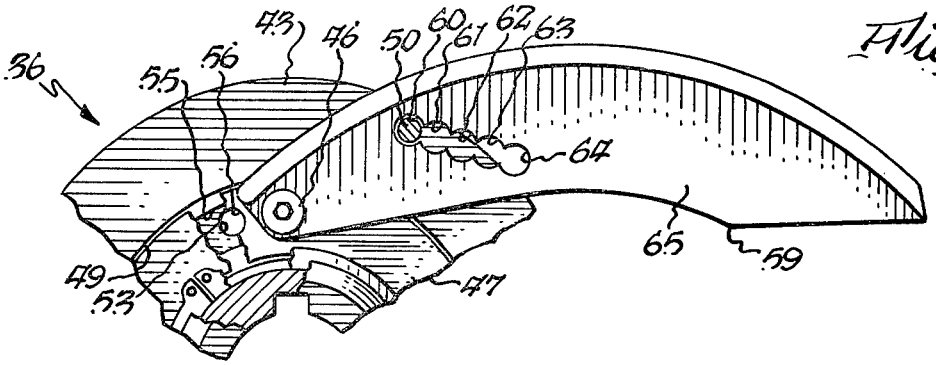
FIG. 8 is a fragmentary plan view similar to FIG. 6 with portions broken away and showing a modified construction for securing the outer portions of the vanes in adjusted positions.

In FIG. 8 a modified vane 59 is shown. The embodiment of FIG. 8 is identical in all respects to the embodiment of FIGS. 6 and 7 except that it utilizes a plurality of linked apertures 60, 61, 62, 63 and 64 in the base 65 instead of the three separate apertures 40, 41 and 42 of FIGS. 6 and 7. As can readily be visualized, this permits a more refined degree of adjustment. However, it is to be noted that screw 50 operates in the same manner as described above relative to FIG. 6 in the sense that screw 50 must be totally removed from each tapped bore 51 and the associated aperture in the vane before it can be reinserted into another aperture such as 61 or 62 and rethreaded into tapped bore 51.

Figure 9:
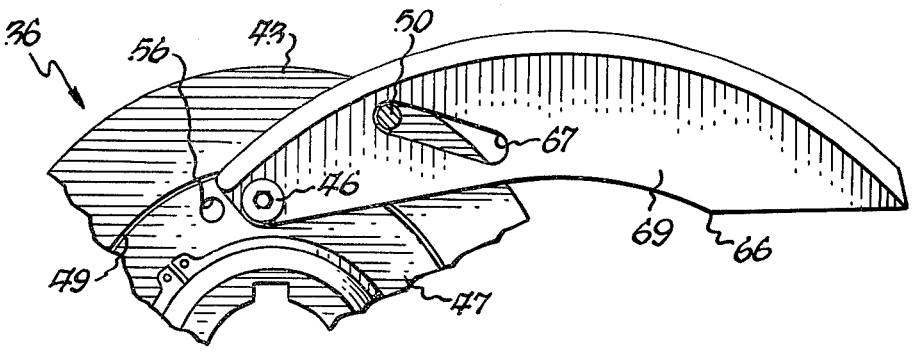
FIG. 9 is a fragmentary plan view similar to FIG. 8 but showing still a further modified fastening construction for the outer portions of the vanes.

In FIG. 9 a still further modified embodiment is disclosed wherein all parts are identical to those described above relative to FIGS. 6 and 7 except for the construction of vane 66 which includes a slot 67 in base 69 thereof for receiving the steam of screw 50. In this embodiment there is no need to remove screw 50 to effect an adjustment of vane 66. It is merely necessary to loosen the screws 50 and 46, rotate annular ring 47 to the desired position, and thereafter retighten screws 46 and 50. The vanes 66 will automatically follow ring 47 to the proper adjusted position.

Figure 10:
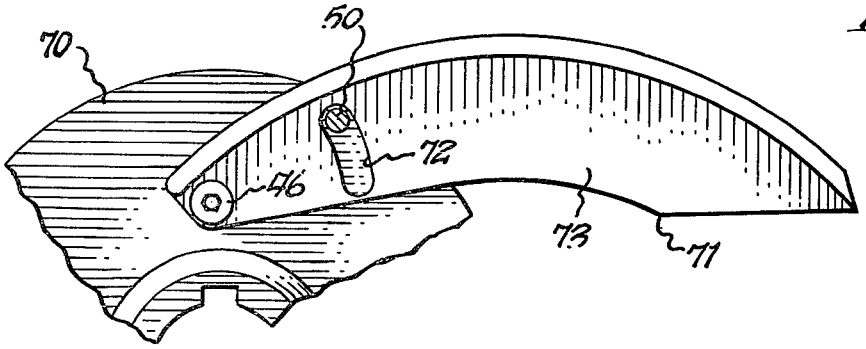
FIG. 10 is a fragmentary plan view of a construction in which the hub does not have an inner annular slidable ring.

In FIG. 10 a still further embodiment of the present invention is disclosed. This embodiment includes a hub 70 which does not have an annular ring 47 or the associated structure. It merely has a series of tapped bores which receive screws 46, said screws extending through oversized apertures, such as 24 of FIG. 2. In addition, a slot 72 is provided in base portion 73 of vane 71. Slot 72 is on a radius with the axis of screw 46 as a center so that vane 71 can swing back and forth, when screws 46 and 50 are loosened. After each vane 71 has been pivoted about the axis of screw 46 to the desired position, screws 46 and 50 are tightened to hold each blade in the desired position. In the embodiment of FIG. 10, each blade 71 must be adjusted individually. All of the blades cannot be adjusted simultaneously by means of a ring, such as 47, because such a ring is not used.

Figure 12:
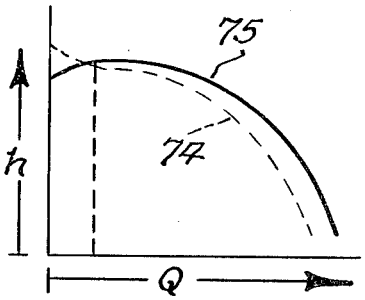
FIG. 12 is a graph showing the characteristic which is obtained by reversal of the vanes as shown in FIG. 11.
Figure 11:
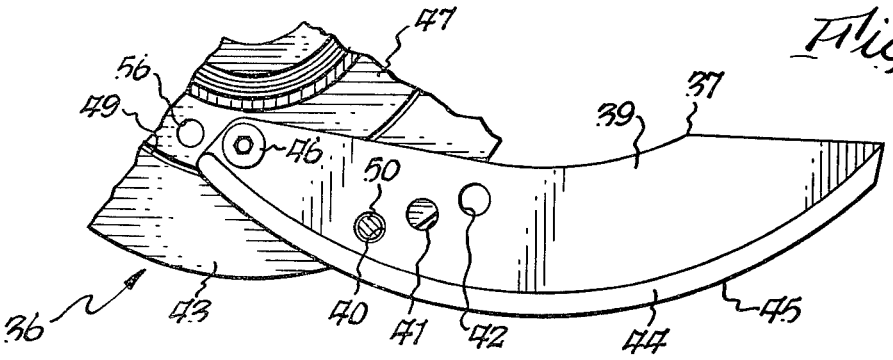
FIG. 11 is a fragmentary plan view of the embodiment of FIG. 6 but having the vane reversed.

In FIG. 11 blade 37 is shown in a reversed position for operation in the same housing in which it operated before reversal. The location of the various fastening means for mounting blade 37 on hub 43 are such that this reversal may be effected by removing the blade from the hub, and moving it in an overcenter manner to a reversed position. By effecting such a reversal, a flow characteristic, such as shown at 74 in FIG. 12, is obtained rather than the flow characteristic curve 75 which is obtained when the blades are in their normal position. In this respect, it is to be noted that with the flow curve 74 of FIG. 12, the flow can be measured by measuring the head.

It can thus be seen that all embodiments of the present invention provide direct fastening between the vanes and the hub portions, without intermediate linkages, and further all embodiments provide full face-to-face contact between overlapping parts of the vanes and the hub, although the direct fastening may be obtained without such full face-to-face contact.

While preferred embodiments of the present invention have been disclosed, it will be appreciated that the present invention is not limited thereto but may be otherwise embodied within the scope of the following claims.

What is claimed is:

1. An adjustable centrifugal impeller comprising a hub, a plurality of elongated vanes located circumferentially on said hub with each of said vanes having inner and outer portions, first fastening means extending between said inner portions of said vanes and said hub for fastening said inner portions to said hub, second fastening means extending between said outer portions of each of said vanes and said hub and movable in a longitudinal direction relative to said vanes for engaging said outer portions of said vanes at varying distances from said first fastening means for fastening said outer portions to said hub in a plurality of different angular positions of said vanes, said hub including an inner portion having an outer circumferential surface and an outer annular portion which is movable relative thereto in a circumferential direction to different circumferential positions, said first fastening means extending between said inner portion of said hub and said inner portions of said vanes, said second fastening means extending between said outer annular portion of said hub and said outer portions of said vanes, whereby both the relative circumferential movement of said inner and outer hub portions and the fastening of each of said second fastening means on the outer portions of said vanes at a predetermined one of said varying distances from said first fastening means will cause each of said vanes to be adjusted to a predetermined angle.

2. An adjustable centrifugal impeller comprising a hub, a plurality of elongated vanes located circumferentially on said hub with each of said vanes having inner and outer portions, first screw receiving means on said inner portions of said vanes for receiving first screws, second screw receiving means on said outer portions of each of said vanes for receiving second screws at varying distances from said first screws, first fastening means including first screws extending directly between said first screw receiving means and said hub for fastening said inner portions directly to said hub, and second fastening means including second screws extending directly between each of said second screw receiving means and said hub for fastening said vanes directly to said hub in a plurality of different angular positions, said hub including an inner portion having an outer circumferential surface and an outer annular portion which is slidable relative to said outer circumferential surface to different circumferential positions, said first screws extending between said inner portion and said first screw receiving means, said second screws extending between said outer annular portion and said second screw receiving means, said second screw receiving means permitting said second screws to be spaced at said varying distances from said first screws to correspond with said different relative circumferential positions of said inner and said outer annular portion of said hub to thereby adjust said vanes to a plurality of angular positions, each of said vanes including a first flat face, and said inner portion including a second flat face, and said outer annular portion including a third flat face, said first and second screws drawing said first flat face into locking face-to-face engagement with said second and third flat faces.

3. An adjustable centrifugal impeller as set forth in claim 2 wherein said first screw receiving means includes a first aperture in each of said vanes for receiving said first screws and wherein said second screw receiving means includes a slot in said outer portion of each of said vanes, said second screws extending through each of said slots.

4. An adjustable centrifugal impeller as set forth in claim 2 wherein said first screw receiving means includes a first aperture in each of said vanes for receiving said first screws and wherein said second screw receiving means includes a plurality of second apertures in each of said vanes, said second screws extending through a preselected one of said plurality of second apertures in each of said vanes.

5. An adjustable centrifugal impeller as set forth in claim 4 wherein each of said slots comprises a plurality of interconnected second apertures.

6. An adjustable centrifugal impeller as set forth in claim 2 wherein said hub includes a front and a rear face, and equalizing means including opening means in said inner portion for permitting communication between said front and said rear of said hub.

7. An adjustable centrifugal impeller as set forth in claim 6 wherein said equalizing means includes second opening means in said rear of said hub, and an annular groove in said hub in communication with said second opening means, said opening means also being in communication with said annular groove.

8. An adjustable centrifugal impeller comprising a hub, a plurality of elongated vanes located circumferentially on said hub with each of said vanes having inner and outer portions, fastening means including a pivotal connection extending directly between said inner portions of said vanes and said hub for fastening said inner portions directly to said hub, screw receiving means in said outer portions of said vane for receiving a screw at varying distances from said pivotal connection, screws extending directly between each of said screw receiving means and said hub for fastening said outer portions directly to said hub in a plurality of different angular positions of said vanes, said hub including an inner portion having an outer circumferential surface and an outer annular portion which is movable relative thereto in a circumferential direction to different circumferential positions, said pivotal connection extending between said inner portion of said hub and said inner portions of said vanes, said screws extending between said outer annular portion and said screw receiving means in said outer portions of said vanes, said screw receiving means including a plurality of second apertures extending generally lengthwise on the outer portion of each of said vanes, said screws extending through a preselected one of said plurality of second apertures in each of said vanes, and means in said outer annular portion for anchoring said screws, whereby both the relative circumferential movement of said inner and outer hub portions and the tightening of said screws in said preselected one of each of said second apertures will cause each of said vanes to be oriented at a predetermined angle.

9. An adjustable centrifugal impeller as set forth in claim 8 wherein said pivot means comprise second screw means.

10. An adjustable centrifugal impeller comprising a hub, a plurality of elongated vanes located circumferentially on said hub with each of said vanes having inner and outer portions, fastening means including a pivotal connection extending directly between said inner portions of said vanes and said hub for fastening said inner portions directly to said hub, screw receiving means in said outer portions of each of said vanes for receiving a screw at varying distances from said pivotal connection, screws extending directly between each of said screw receiving means and said hub for fastening said outer portions directly to said hub in a plurality of different angular positions of said vanes, said hub including an inner portion having an outer circumferential surface and an outer annular portion which is movable relative thereto in a circumferential direction to different circumferential positions, said pivotal connection extending between said inner portion of said hub and said inner portions of said vanes, said screw receiving means including a slot extending generally lengthwise on said outer portion of each of said vanes, said screws extending through each of said slots, and means in said outer annular portion for anchoring said screws, whereby both the relative circumferential movement of said inner and outer hub portions and the tightening of said screws at a predetermined position in each of said slots will cause each of said vanes to be oriented at a predetermined angle.

11. An adjustable centrifugal impeller as set forth in claim 10 wherein said pivot means comprise second screw means.

* * * * *